US005814250A

United States Patent [19]

Dudt et al.

[11] Patent Number: 5,814,250

[45] Date of Patent: Sep. 29, 1998

[54] METHOD OF PROTECTING A STRUCTURE

[75] Inventors: Philip J. Dudt, Rockville; John R. Martin, Union Bridge, both of Md.

[73] Assignee: The United States of America as represented by the Secretary of the Navy, Washington, D.C.

[21] Appl. No.: 710,498

[22] Filed: Sep. 18, 1996

[51] Int. Cl.[6] ..... E04B 1/16

[52] U.S. Cl. ..... 264/31; 264/241; 264/257; 264/331.11; 264/DIG. 6

[58] Field of Search ..... 264/257, 319, 264/331.11, 241, DIG. 6, 31

[56] References Cited

U.S. PATENT DOCUMENTS

| | | | |
|---|---|---|---|
| 4,404,889 | 9/1983 | Miguel | 89/36 A |
| 4,595,623 | 6/1986 | Du Pont et al. | 428/195 |

*Primary Examiner*—Christopher Raimund
*Attorney, Agent, or Firm*—John Forrest; Gary Borda; Jacob Shuster

[57] ABSTRACT

The invention is directed to a lightweight barrier and armor materials and, more particularly, to a method of using a syntactic foam for protecting a desired portion of a fixed structure (e.g., building) or movable structure (e.g., armored vehicle or ship) from ballistic impact. The method of the present invention includes the following steps: (1) providing a mold defining therein a predetermined shape or an enclosed space in a fixed or movable structure; (2) providing a mixture of between about 40 percent and about 80 percent by volume of microspheres and between about 60 percent and about 20 percent by volume of an uncured binder material; (3) pouring the mixture into the mold; (4) curing the mixture to form a syntactic foam barrier material in the form of the predetermined shape; and (5) placing the barrier material in a relationship with the structure to be protected wherein the desired portion of the structure is protected from ballistic impact. The resulting protective barrier material is adapted to absorb and contain bullets and other ballistic penetrators and to maintain structural integrity upon impact thereof. The present method may further include the steps of providing external reinforcement and/or internal ballistic impact absorbing components to the barrier material.

12 Claims, 2 Drawing Sheets

METHOD OF PROTECTING A STRUCTURE

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to barrier and armor materials and, more particularly, to the use of syntactic foams as a bullet and other penetrating fragment absorber for lightweight armor and protection barriers and as a method of protecting fixed and movable structures from ballistic impact.

2. Brief Description of Related Art

Current barriers used in protecting buildings and other structures against impact of bullets and explosive fragments resulting from terrorist or other attacks are generally constructed of heavy materials such as concrete. Such barriers do not absorb impacting objects easily, but can allow bullets to ricochet and other metal and/or concrete fragments to become hazardous to personnel. This creates a dangerous situation for bystanders and limits the ability of law enforcement personnel in addressing the situation. Moreover, once damaged, heavy lifting equipment may be required to move the barriers.

Armor used to protect moveable structures, such as armored vehicles and Naval vessels, is typically made of hardened steel. Such armor adds considerable weight to the vehicle. Consequently, heavier more powerful engines are required to move the vehicle at the required speed. Moreover, the added weight reduces the payload capacity and effective range of the vehicle.

Thus, there is a need for a means and method of protecting fixed and movable structures from impact of bullets and other ballistic projectiles and fragments that overcomes the problems associated with present armor and barrier materials.

Additionally, there is frequently a requirement to test the penetration power of various ballistic penetrators in a very controlled fashion. Thus, there is a need for a means and method of absorbing impacting ballistic penetrators in a controlled and consistent manner without damaging the penetrator so that an evaluation of their ballistic characteristics and capabilities may be conducted.

SUMMARY OF THE INVENTION

Accordingly, it is an object of the present invention to provide a lightweight armor or protective barrier material.

It is a further object of the present invention to provide a material capable of absorbing bullets and other fragments and providing a surface where ricocheting will be greatly reduced.

It is yet a further object of the present invention to provide an armor or protective barrier material that is capable of easily filling void areas in a structure and is easily fabricated to conform to a predetermined shape.

It is still a further object of the present invention to provide a lightweight means and method for protecting fixed and movable structures from the impact of bullets and other fragments.

It is still a further object of the present invention to provide a medium for assessing the stopping power of ballistic penetrators in a controlled fashion.

Other objects and advantages of the present invention will become apparent to those skilled in the art upon a reading of the following detailed description taken in conjunction with the drawings and the claims supported thereby.

In accordance with the present invention, these objects are met by providing a method of using a syntactic foam for protecting a desired portion of a structure from ballistic impact. The method of the present invention includes the following steps: (1) providing a mold defining therein a predetermined shape; (2) providing a mixture of between about 40 percent and about 80 percent by volume of microspheres and between about 60 percent and about 20 percent by volume of an uncured binder material; (3) pouring the mixture into the mold; (4) curing the mixture to form a syntactic foam barrier material in the form of the predetermined shape; and (5) placing the barrier material in a relationship with the structure to be protected wherein the desired portion of the structure is protected from ballistic impact. The resulting protective barrier material is adapted to absorb and contain bullets and other ballistic projectiles and to maintain structural integrity upon impact thereof.

In one preferred embodiment of the present invention, the structure may be a vehicle such as an armored vehicle or a Naval vessel. In such a case the mold takes the form of adjacent structural members of the vehicle, the adjacent structural members defining a space capable of containing the mixture.

In another preferred embodiment of the present invention, the structure may be a building wherein the predetermined shape conforms to (a) a free standing barrier for placement adjacent the portion of the building to be protected, or (b) an architectural feature of the building, e.g., walls, floors, ceilings and doors.

The present method may further include the step of providing one or more internal ballistic impact absorbing components to the barrier material to enhance barrier performance. The one or more internal components may be fibers, fiber mats or ceramic tiles that function to increase the stopping power and decrease the penetration distance of impacting projectiles, or may be hard particles or metal plates that, upon impact by ballistic projectiles, additionally function to cause the projectiles to turn off-axis. The one or more internal components may be incorporated within the barrier material by placing them within the mold prior to pouring in the uncured mixture, or by incorporating them into the uncured mixture.

The present method may further include the step of providing external reinforcement to the barrier material to enhance barrier performance. The external reinforcement may be individual fibers, fiber cloth, fiber mats or metal sheet. The external reinforcement may be embedded in, wrapped around, or mounted to a perimeter region of the barrier material, or a combination thereof. Preferably, the external reinforcement is located so as to reinforce edges and corners of the barrier material against spalling or splitting.

In a further embodiment of the present invention, a very consistent lightweight medium for absorbing ballistic impact is provided. The lightweight medium may be used as a barrier and/or for evaluating the penetration of various penetrators having different shapes, sizes, and velocities. The medium comprises a syntactic foam configured into a predetermined shape and adapted to absorb and contain bullets and other ballistic penetrators and to maintain structural integrity upon impact thereof.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding elements throughout and wherein.

DETAILED DESCRIPTION OF THE PREFERRED EMBODIMENT

The inventors have discovered and demonstrated that syntactic foam materials are capable of absorbing and containing ballistic projectiles (e.g., bullets) and other penetrators (e.g., potentially penetrating fragments from explosives) that impact the surface of the material at high velocities. Syntactic foam is an intimate mixture of small, hollow particles and a binder material. The particles are typically small, hollow spheres generally referred to as microspheres or microballoons. The microspheres can be made of glass, rubber, plastics, metals, ceramics, and carbon. Such syntactic foams are lightweight and may be compounded so as to be buoyant in water.

Figure 1:
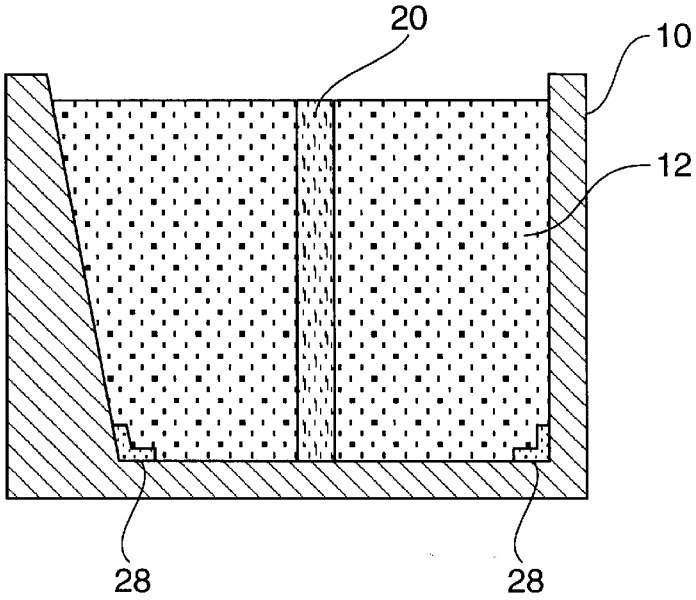
FIG. 1 is a cross-sectional view showing a mold for manufacturing a barrier in accordance with one embodiment of the present invention, the mold containing the barrier material and internal ballistic impact absorbing components and external reinforcements.
Figure 2:
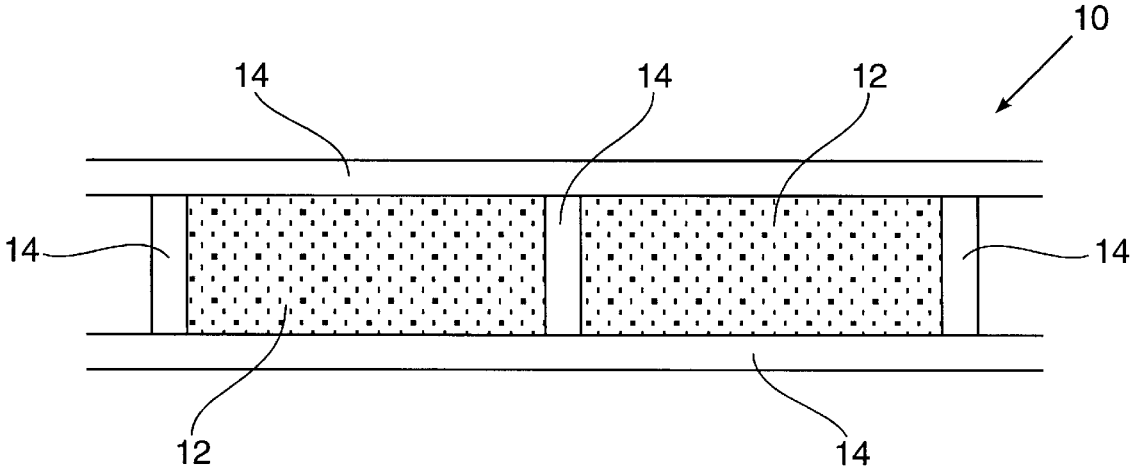
FIG. 2 is a cross-sectional view of an alternative embodiment of the present invention showing a mold comprising adjacent structural members of a vehicle or a building, the adjacent structural members defining a space containing the barrier material.

Referring now to the drawings, and particularly to FIG. 1 and 2, the present means and method for protecting a desired portion of a structure from ballistic impact are illustrated. Means for protecting a structure from ballistic impact takes the form of lightweight protective barrier or armor material 12. Protective barrier 12 comprises a syntactic foam configured into a predetermined barrier shape. Protective barrier 12 may be advantageously manufactured in accordance with the present invention using pour-in-place methods. Thus, the present invention may be used as a void filler in buildings and vehicles or may be manufactured in molds shaped to the desired finished product.

The method of the present invention includes the following steps: (1) providing a mold 10 defining therein a predetermined shape; (2) providing a mixture of between about 40 percent and about 80 percent by volume of microspheres and between about 60 percent and about 20 percent by volume of an uncured binder material; (3) pouring the mixture into mold 10; (4) curing the mixture to form a syntactic foam barrier material 12 in the form of the predetermined shape; and (5) placing barrier material 12 in a relationship with the structure to be protected wherein the desired portion of the structure is protected from ballistic impact. The resulting protective barrier material 12 is adapted to absorb and contain bullets and other ballistic penetrators and to maintain its structural integrity upon impact by the bullets and other ballistic penetrators.

Preferably, the microspheres have diameters less than about 300 microns. In the preferred embodiments of the present invention, the microspheres are made of glass, plastics, ceramics, or carbon. The preferred binder materials are thermosetting resins and thermoplastic resins, such as, epoxy resin, polyester resin, polystyrene resin, or polycarbonate resin. By adjusting the volume percentage of microspheres in the mixture, the syntactic foams of the present invention can be fabricated to desired densities. The preferred foam mixture is between about 40% and about 80% by volume of microspheres with the remainder being binder material. For pour-in-place methods, the preferred foam mixture is between about 50% and about 70% by volume of microspheres. For percentages of microspheres higher than those commonly used for basic pour-in-place methods, the foam mixture may be poured and then a predetermined amount of binder material may be extracted from the mixture using techniques well known in the art. Resulting, densities can range from about 20 $lb/ft^3$ and up as needed for a particular application.

In one preferred embodiment of the present invention, as may be represented by FIG. 2, the structure may be a building or a vehicle (e.g., an armored land vehicle or a Naval vessel). In this embodiment, the mold takes the form of adjacent structural members 14 of the building or vehicle. Adjacent structural members 14 define a space therein capable of containing the uncured mixture of barrier material 12. The particular space created by structural members 14 for containing barrier material 12 will be located adjacent the portion of the building or vehicle to be protected. Consequently, step (3), i.e., the pouring step, and step (5), i.e., the placing step, are performed simultaneously by pouring the mixture into the space created by structural members 14. Thus, in this preferred embodiment, barrier material 12 may be poured, prior to curing, into void areas and allowed to cure in place to provide a lightweight bullet and fragment absorbing armor 12 surrounding critical areas of the structure needing such protection, e.g., personnel spaces, or spaces containing delicate equipment, engines, fuel or munitions. For example, in waterborne (surface and underwater) vessels the uncured material may be poured between frames and webs supporting the hull structure, between inner and outer hulls of double hulled vessels, or into bilge areas or wall panels. Moreover, in waterborne vessels, the foam material may be compounded to be buoyant in water to provide added fixed buoyancy to the vessel. In land vehicles the uncured material may be poured into void areas such as are typically found under seats, under floorboards, or in door and side panels. In buildings the uncured material may be poured into void areas such as are typically found between walls and under floors.

Figure 3:
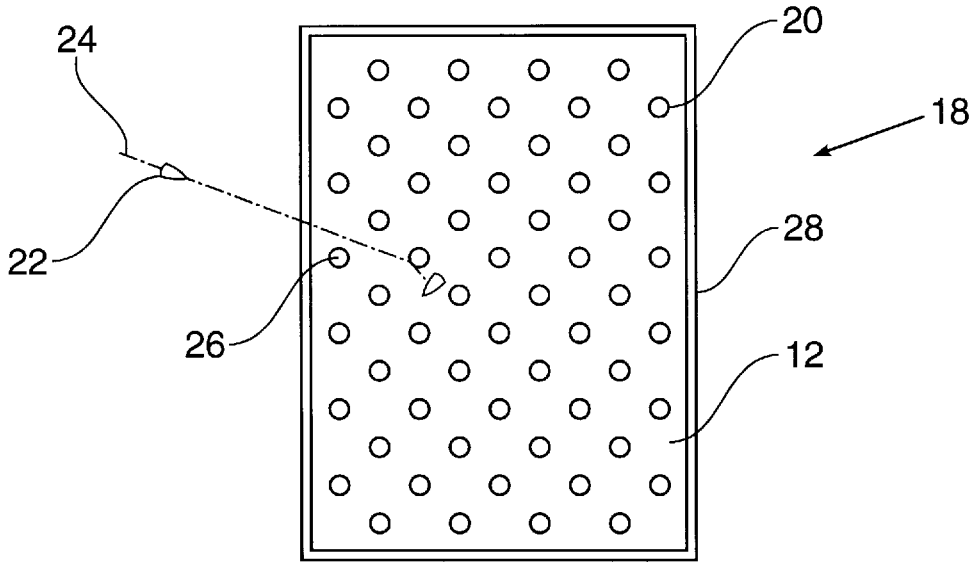
FIG. 3 is a cross-sectional view of an exemplary embodiment of the barrier or armor material of the present invention showing external reinforcement in the form of a reinforcing wrapping and internal ballistic impact absorbing components in the form of hard particles capable of deflecting projectiles and turning them off-axis.
Figure 4:
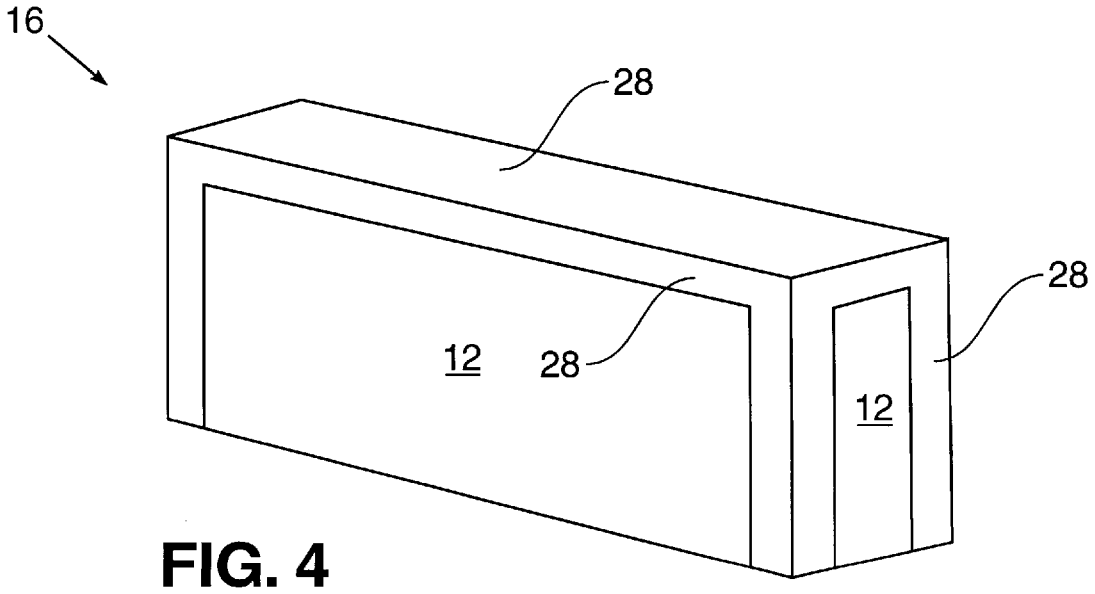
FIG. 4 is a perspective view of an exemplary embodiment of the barrier or armor material of the present invention showing external reinforcement embedded at the edges of the material.

In another preferred embodiment of the present invention, the structure may be a building wherein the predetermined shape conforms to (a) free standing barrier 16 as shown in FIG. 4 for placement adjacent the portion of the building to be protected, or (b) architectural feature 18 of the building as represented symbolically in FIG. 3. Architectural feature 18 may be, for example, walls, floors, ceilings or doors. Thus, step (5), i.e., the placing step, comprises mounting the barrier material to the building abutting the architectural feature. In this preferred embodiment, the protective barrier or armor components 12 can be manufactured by forming molds in any desired shape, filling the mold with the uncured foam material, curing the material, removing the finished component, and mounting the finished component in the desired area. Barriers conforming to architectural features of the building may be attached directly to exterior surfaces to which they conform or may be mounted within wall, ceiling and floor areas. Alternatively, free-standing barriers may be located outside of the building adjacent to areas of the building requiring protection.

In order to improve the stopping and absorbing capabilities of protective barrier or armor material 12, the present method may further include the step of providing one or more internal ballistic impact absorbing components 20 to barrier material 12 as shown in FIGS. 1 and 3. Internal components 20 may be fibers, fiber mats, ceramic tiles, or metal plates (as represented in FIG. 1) that function to increase the stopping power and decrease the penetration distance of impacting ballistic penetrators, or hard particles (as represented in FIG. 3) additionally capable, upon impact by ballistic projectile 22, of turning projectile 22 off-axis. By causing projectile 22 to tumble off its axis of trajectory 24 (i.e., the axis of the projectile that extends in the direction of travel of the projectile), projectile 22 presents a larger frontal area to the material resulting in a much shorter penetration distance. Internal components 20 may be incorporated within barrier material 12 by placing them within mold 10 prior to pouring in the uncured mixture, or by incorporating them into the uncured mixture. Thus, for example, one or more layers of fibers, cloth, ceramic armor tiles, metal plates, and/or hard particles may be molded into barrier material 12 during the manufacturing process or may be strategically placed in the areas where the uncured mixture will be poured. Fibers and fiber mats can be made, for example, from glass, nylon, kevlar or polyethylene fiber materials. Hard particles 26 can be, for example, hollow or solid ceramic spheres, pieces of metal or kevlar, or other hard materials. Hard particles 26 are shown in FIG. 3 as being spherical particles distributed in a regular pattern or predetermined array. However, hard particles 26 may be any shape and may be randomly distributed. Metal plates can be located at specific distances representing a filled, spaced armor. Additionally, metal plates can be placed at an angle to the surface of barrier material 12 so that they will be capable, upon impact by ballistic projectile 22, of turning projectile 22 off-axis.

To prevent possible spalling, fracture or fragmentation of protective barrier or armor material 12 upon impact of bullets and other ballistic penetrators, the present method may further include the step of providing external reinforcement 28 to barrier material 12 as illustrated in FIGS. 1, 3 and 4. External reinforcement 28 may be individual fibers, fiber cloth, fiber mats, or metal sheets or plates. Preferably, because of their lightweight, external reinforcement 28 is made of fibers, fiber cloth or fiber mats. External reinforcement 28 may be embedded into a perimeter region of barrier material 12 (as in FIGS. 1 and 4), may be mounted onto or wrapped around a perimeter region of barrier material 12 (as in FIG. 3), or a combination thereof. Thus, barrier or armor component 12 may have one or more fiber and/or metal layers embedded into, mounted onto, or wrapped around its perimeter, or portions thereof. Preferably, external reinforcement 28 is placed at portions of barrier or armor component 12 that is most vulnerable to possible spalling, fracture or fragmentation, e.g., in the corner or edge areas of barrier or armor component 12.

A number of tests were conducted with lightweight barrier material 12 of the present invention to test its ballistic performance as a stopping medium. The syntactic foam that was evaluated was originally procured by the U.S. Navy for buoyancy purposes. This particular syntactic foam, which was produced by Emerson and Cuming of Canton, Mass., is composed of about 75% by volume of glass microspheres in a styrene resin base and has the following properties: nominal density of 28±0.5 lb/ft$^3$; nominal tensile strength of 3500 psi; nominal compressive strength of 8000 psi; and a compressive modulus on the order of 310,000 psi. The use of this particular foam for evaluation purposes is not intended as a limitation on the present invention and it is to be understood that other foam mixtures may also be used for practicing the present invention. Four commercially available rifle and pistol cartridges were used to evaluate the response of the basic syntactic foam to different ballistic threats. The following types of round were fired into the foam during the evaluation: 22 long rifle round; 9 mm Lugar round; 45 caliber ACP round; and .223 (5×56 NATO) rifle round.

22 LONG RIFLE ROUND

Three tests were conducted using a commercially available 22 long rifle round having a lead projectile weighing 40 grains. Two tests were conducted with rounds fired from about 25 feet using a Ruger 10/22 rifle. During the first test, about 200 rounds were fired into a 12×12×6 inch block of foam. The rounds penetrated the foam with the foam stopping the bullets and the block remaining intact. However, when the bullets struck near an edge, there was some chipping away of the block. During the second test, two rounds were fired into a 4×6×9 inch block of foam. The block was then cut open so that the projectiles could be viewed. The projectiles had only minimal deformation. A third test was conducted with rounds fired from about 30 feet using a Remington target rifle. During this test, three rounds were fired into a 4×6×9 inch block of foam in order to measure depth of penetration of the projectiles. The resulting depth of penetration of the three rounds was very consistent varying between 1.90 and 1.97 inches.

9 mm LUGER ROUND

A commercially available Beretta 92F sidearm was used to fire typical U.S. military spec 9 mm ball ammunition having a full metal jacket projectile weighing 124 grains. The 9 mm Luger round has a larger diameter than the 22 long rifle round. Three rounds were fired from about 30 feet into a 4×6×9 inch block of foam. The block remained intact with no evidence of cracking or spalling. The average depth of penetration was 2.46 inches.

45 CALIBER ACP ROUND

A commercially available Colt 1911 government model sidearm was used to fire typical U.S. military spec ball ammunition having a projectile weight of 230 grains. Three rounds were fired from about 30 feet into a 4×6×9 inch block of foam. The small block spit into three pieces; however, the projectile was stopped in each case. A 6×6×12 inch foam block was similarly shot with no breakup or evidence of collateral damage to the material. All projectiles were stopped, yielding an average depth of penetration of 1.87 inches

.233 (5×56 NATO) RIFLE ROUND

A commercially available "military style" rifle was used to fire two typical military spec ball rounds having a projectile weight of 55 grains. The 5×56 NATO rifle round has a much higher velocity than the other rounds used. Six 4×6×9 inch blocks of foam were stacked to create a block measuring 24×6×9 inches. A larger block was tested after four preliminary shots indicated that a larger stopping distance was required for the 5×56 NATO rounds. The projectiles penetrated the blocks with little observable affect on the block or deformation of the projectile. The projectiles followed a straight trajectory through the block to an average penetration depth of 21.98 inches.

Syntactic foams used as a ballistic barrier, as described for the present invention, exhibit an excellent capacity for absorbing and stopping a number of ballistic penetrators within a short distance without detrimental effects. For small projectiles or fragments similar in size to a 22 long rifle round and at speeds on the order of 1200 ft/sec, the barrier material of the present invention exhibits a large capacity for absorbing multiple hits while retaining material integrity. Near edges, a fiber reinforced wrapping, insertion of fiber mats or metal sheeting along edges during manufacture of the barrier, or mounting of fiber mats or metal sheeting subsequent to manufacture should solve problems of edge spalling. For larger handgun projectiles, such as the 45 caliber ACP round, the barrier readily contained all rounds, although a thicker barrier (if comparable in composition to the one tested) than that used for smaller rounds would likely be required to prevent cracking. Again, external reinforcement could be incorporated to prevent breakup. For smaller, higher velocity rounds, such as the 5×56 NATO round, internal ballistic impact absorbing components in the form of ballistic tiles, fibers, or hard particles may be incorporated into the foam to increase the stopping power of the barrier resulting in much smaller penetration distances.

The advantages of the present invention are numerous. The present syntactic foam barrier and armor material is capable of absorbing and containing bullets and other penetrators that impact its surface. The present method of protecting structures from ballistic impact provides a barrier that eliminates dangerous ricocheting of ballistic projectiles and barrier fragments associated with prior art barrier and armor materials and, thus, provides added protection for nearby personnel and bystanders. Moreover, the embedded bullets or other fragments can be saved for later evaluation. The material may also be used for purpose of researching the properties of new bullet or charge configurations. When used as a lightweight armor material, the present invention may improve the speed, range, and/or payload capacity of military and commercial vehicles and vessels. Additionally, when installed in waterborne crafts and vessels, the armor material could serve the dual purpose of providing buoyancy. Components such as fibers, cloth, ceramic tiles, and hard particles may be incorporated into the design and fabrication of the present invention to enhance its ability to absorb and stop bullets and other fragments and to prevent possible fragmentation of the lightweight material.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. It is therefore to be understood, the forms of the present invention herein described are not intended to be limiting but are merely preferred or exemplary embodiments thereof and, within the scope of the appended claims, the invention may be practiced other than as specifically described.

What is claimed is:

1. A method of protecting a desired portion of a structure from ballistic impact and penetration, said method comprising the steps of:

providing a mold defining therein a predetermined shape;

providing a mixture of microspheres within a volumetric range of 40 to 80 percent and an uncured binder material within a volumetric range of 20 to 60 percent;

pouring said mixture into said mold;

curing said mixture to form a syntactic foam barrier material in the form of said predetermined shape adapted to absorb and contain ballistic projectiles while maintaining structural integrity upon ballistic impact and penetration; positioning one or more penetration impeding layers within the barrier material for decreasing penetration of the ballistic projectiles; and placing said barrier material in a relationship with said structure wherein said desired portion of said structure is protected from ballistic impact and penetration.

2. A method as in claim 1, wherein said microspheres are selected from the group consisting of glass microspheres, plastic microspheres, ceramic microspheres, carbon microspheres and a combination thereof.

3. A method as in claim 1, wherein said binder material is selected from the group consisting of thermosetting resins and thermoplastic resins.

4. A method as in claim 2, wherein said microspheres have a diameter of less than about 300 microns.

5. A method as in claim 1, wherein:

said mold comprises adjacent members of said structure defining a space capable of containing said mixture; and said pouring step and said placing step are performed simultaneously by pouring said mixture into said space located adjacent said portion of the structure to be protected.

6. A method as in claim 1, wherein said one or more layers are formed from fibers, fiber mats, ceramic tiles, metal plates, hard particles or a combination thereof.

7. A method of protecting a desired portion of a structure from ballistic impact, and penetration said method comprising the steps of:

providing a mold defining therein a predetermined shape;

providing a mixture of between about 40 percent and about 80 percent by volume of microspheres and between about 60 percent and about 20 percent by volume of an uncured binder material;

pouring said mixture into said mold;

curing said mixture to form a syntactic foam barrier material in the form of said predetermined shape, said barrier material adapted to absorb and contain ballistic projectiles and to maintain structural integrity upon ballistic impact;

placing said barrier material in a relationship with said structure wherein said desired portion of said structure is protected from ballistic impact; and incorporating within said barrier material one or more layers respectively formed by fibers, fiber mats, ceramic tiles, metal plates, hard particles or a combination thereof, said fibers and fiber mats being made of a fiber material selected from the group consisting of glass, nylon, aramid and polyethylene, said one or more layers functioning to decrease penetration into the barrier material of said ballistic projectiles.

8. A method as in claim 1, comprising the further step of:

providing external reinforcement to said barrier material, said external reinforcement being embedded in a perimeter region of said barrier material, mounted on a perimeter region of said barrier material, wrapped around a perimeter region of said barrier material, or a combination thereof.

9. A method as in claim 8 wherein said external reinforcement is selected from the group consisting of individual fibers, fiber cloth, fiber mat, and metal sheet, and further wherein said external reinforcement is located so as to reinforce edges and corners of said barrier material.

10. A method of protecting a structure from ballistic impact by applying to a portion of the structure an impact absorbing barrier having a ballistic penetration decreasing layer positioned therein, including the steps of: mixing microspheres with an uncured binder to form a liquified mixture; pouring said liquified mixture into a mold defining a predetermined shape conforming to said portion of the structure; and curing the binder in said mixture filling the mold to form said barrier having said predetermined shape for application to said portion of the structure with the layer spaced therefrom in a direction of the ballistic impact.

11. The method as defined in claim 10, further including the step of: positioning a reinforcement within the mold prior to said step of pouring the liquified mixture thereinto, whereby the barrier is formed lined with the reinforcement.

12. A method as defined in claim 10, wherein said mold is formed within the structure into which the liquified mixture is poured, said microspheres being within a volumetric range of about 50 to 70 percent of the mixture.

* * * * *